US007185841B2

(12) United States Patent
Kaufmann

(10) Patent No.: US 7,185,841 B2
(45) Date of Patent: Mar. 6, 2007

(54) HYGIENIC PAPER DISPENSER

(76) Inventor: Werner Kaufmann, Lochweg 2
CH-5033, Buchs (CH)

( * ) Notice: Subject to any disclaimer, the term of this patent is extended or adjusted under 35 U.S.C. 154(b) by 0 days.

(21) Appl. No.: 10/497,412

(22) PCT Filed: Nov. 19, 2002

(86) PCT No.: PCT/CH02/00620

§ 371 (c)(1),
(2), (4) Date: Jun. 2, 2004

(87) PCT Pub. No.: WO03/047410

PCT Pub. Date: Jun. 12, 2003

(65) Prior Publication Data

US 2005/0077420 A1 Apr. 14, 2005

(30) Foreign Application Priority Data

Dec. 7, 2001 (CH) ..... 2244/01

(51) Int. Cl.
*B65H 20/02* (2006.01)

(52) U.S. Cl. ..... 242/564.4; 242/594.5; 242/905

(58) Field of Classification Search ..... 242/564, 242/564.1, 564.2, 564.3, 564.4, 565, 560, 242/560.2, 905, 594.5
See application file for complete search history.

(56) References Cited

U.S. PATENT DOCUMENTS 913,614 A * 2/1909 Brownson
3,025,829 A * 3/1962 Smith
3,084,664 A * 4/1963 Perlman et al.
3,368,522 A * 2/1968 Cordis
4,041,900 A * 8/1977 Charles
4,620,502 A * 11/1986 Kimble
4,747,365 A * 5/1988 Tusch
4,756,485 A * 7/1988 Bastian et al.
4,984,530 A * 1/1991 Dutton
4,991,538 A * 2/1991 Davids et al.
5,660,636 A * 8/1997 Shangold et al.
5,951,762 A * 9/1999 Shangold et al.
6,145,779 A * 11/2000 Johnson et al. ..... 242/564.2
6,547,881 B1 * 4/2003 Klockner
6,820,785 B2 * 11/2004 Kapiloff ..... 242/564.4

FOREIGN PATENT DOCUMENTS

WO 03/047410 A1 * 12/2003

* cited by examiner

*Primary Examiner*—William A. Rivera
(74) *Attorney, Agent, or Firm*—Abelman, Frayne & Schwab

(57) ABSTRACT

A dispenser for hygiene paper is proposed which makes available dry toilet paper and dispenses moistened hygiene paper. For this purpose, the dispenser contains a housing, a roll holder for the hygiene paper, a unit for the moistening with a liquid container, a moistening roll and at least one liquid tank which communicate with one another and a unit for the dispensing with a transport roll for the hygiene paper which is in contact with the moistening roll with an intermediate layer of the hygiene paper. The dispenser can be divided into a base housing and an insertion part.

Figure 1:
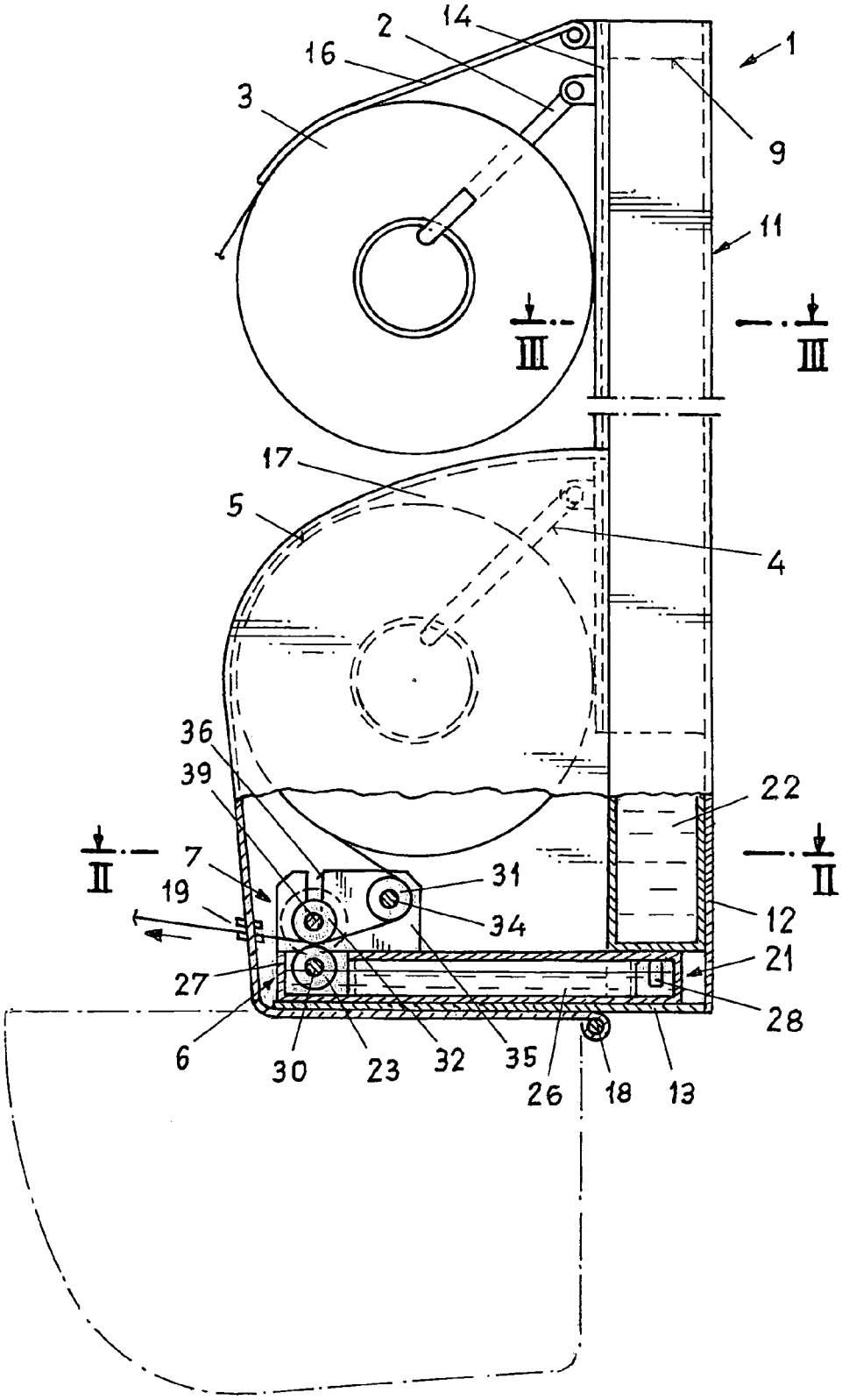

The advantage of the dispenser consists of commercially available toilet paper being made available and of moistened hygiene paper being dispensed in a specific length or in any desired length and of the dispenser being made simply and being easy to handle.

16 Claims, 6 Drawing Sheets

HYGIENIC PAPER DISPENSER

The invention relates to a dispenser for hygiene paper containing a housing, a first roll holder for the reception of a roll with a hygiene paper, a unit for the moistening of the hygiene paper with a liquid container, with a moistening roll and with a liquid tank which communicates with the liquid container (21) and the moistening roll and a guide roll for the hygiene paper.

Dry toilet paper and moist cleaning tissues are used for hygiene. In use, it has been found to be disadvantageous that the toilet paper and the cleaning tissues are presented spatially separately and the moist cleaning tissues can dry out. This can be very unpleasant in certain situations.

In DE A 26 44 871, a toilet tank is described from which dry and moistened toilet paper can be taken from a dispensing roll. The tank substantially consists of a housing in which a roll holder for the toilet paper is arranged and a flask which is arranged outside the housing. A deflection roll for the toilet paper, a transport roll for the toilet paper standing under spring action, a liquid container which communicates with the flask and a moistening roll which is connected to the liquid container line-wise are arranged in the tank. The toilet paper is guided over the deflection roll and the transport roll and is held by these at a member with a tear-off edge. Dry toilet paper can be pulled off in this position. To moisten the toilet paper, the toilet paper is brought—against the spring action—into contact with the roll standing in line-wise connection with the liquid container.

The disadvantages of the tank can be seen in the fact that the toilet paper is moistened by pulling the toilet paper against the spring action, with the degree of moistening depending on the pull-off speed. Toilet paper can thereby be moistened only partly or too strongly. With too high a pulling force, the moistened toilet paper can be torn or the dry toilet paper can be torn off outside the perforation and is consequently unusable. The tank is not suitable for the use of non-perforated hygiene paper from the roll. The reason for this can be seen in the relatively high tear strength of the hygiene paper.

It is the underlying object of the invention to provide a dispenser for hygiene paper which does not have the aforesaid disadvantages.

The object is satisfied in accordance with the invention by the features of the independent claim. Further developments of the invention result from the dependent claims.

It is the underlying idea of the invention to make available by means of a dispenser dry hygiene paper or to present moistened hygiene paper, which can be used as toilet paper or as a cleaning tissue after the tearing off. There are provided for this purpose, roll holders for the respective hygiene paper arranged at a housing, a unit for the moistening of the hygiene paper with a liquid tank, a liquid container and a moistening roll, which communicate with one another, a unit for the dispensing with a transport roll for the transport of the hygiene paper, the transport roll being in contact with the moistening roll through the intermediary of a layer of the hygiene paper, with a drive unit for the transport roll and a control unit.

The advantages which can be achieved with the invention can substantially be seen in the fact that commercially available dry toilet paper is made available and moistened hygiene paper is dispensed usable as cleaning tissues and in that the dispenser is simply made and is simple to handle.

It is of advantage for the housing to consist of a base housing and an insertion part which are connected via plug connections, for three liquid tanks to be arranged at the base housing and for the insertion part to include the liquid container. The servicing and in particular the cleaning of the dispenser is thereby facilitated.

A hood with a means for the separation of the hygiene paper can be provided for the covering of the roll with the hygiene paper and of the liquid container. The wet portion of the dispenser is thus covered and the possibility is provided of using both perforated and non-perforated hygiene paper.

If the guide roll and the transport roll are rotatably arranged in the hood, the hygiene paper can easily be inserted in an advantageous manner when the hood is pivoted downwardly.

The invention will be explained with reference to the enclosed drawings in the following.

Figure 2:
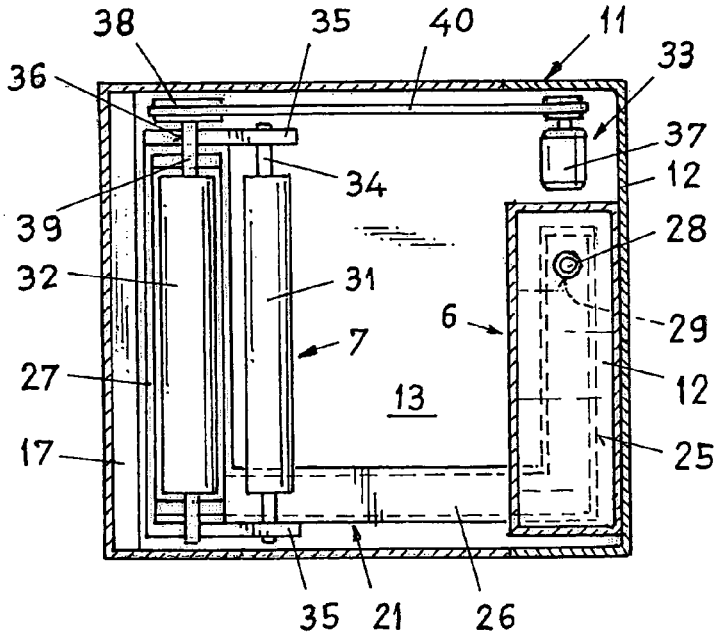
Figure 3:
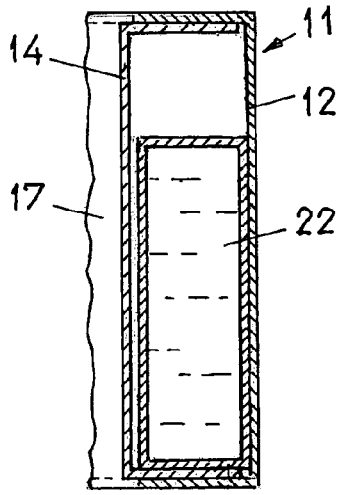
Figure 5:
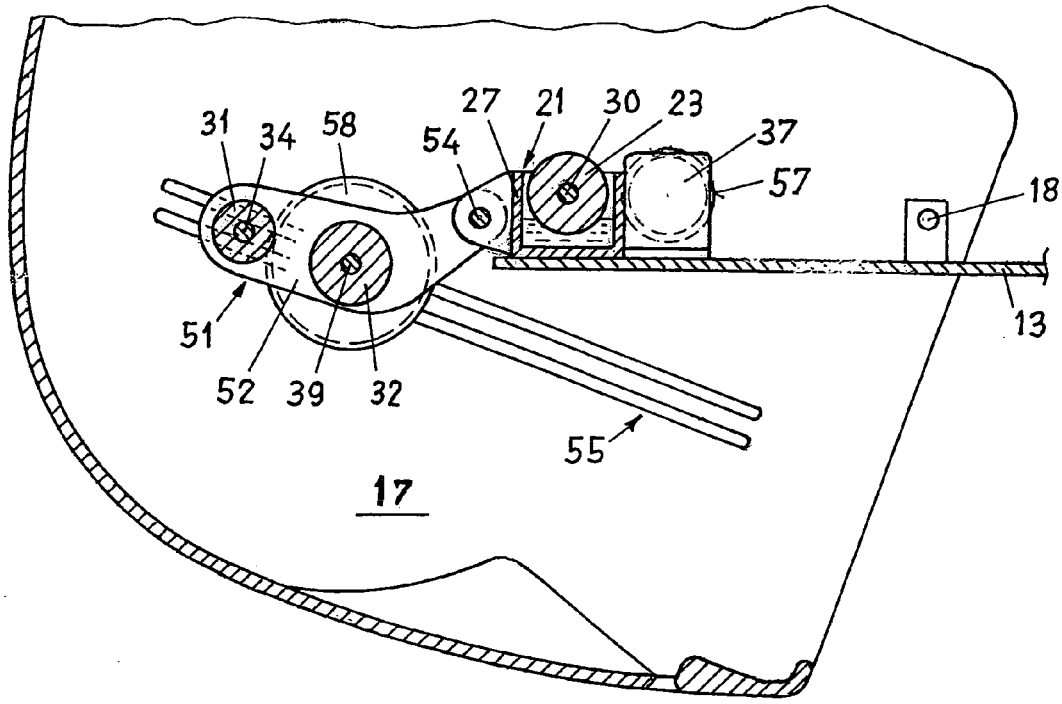
Figure 4:
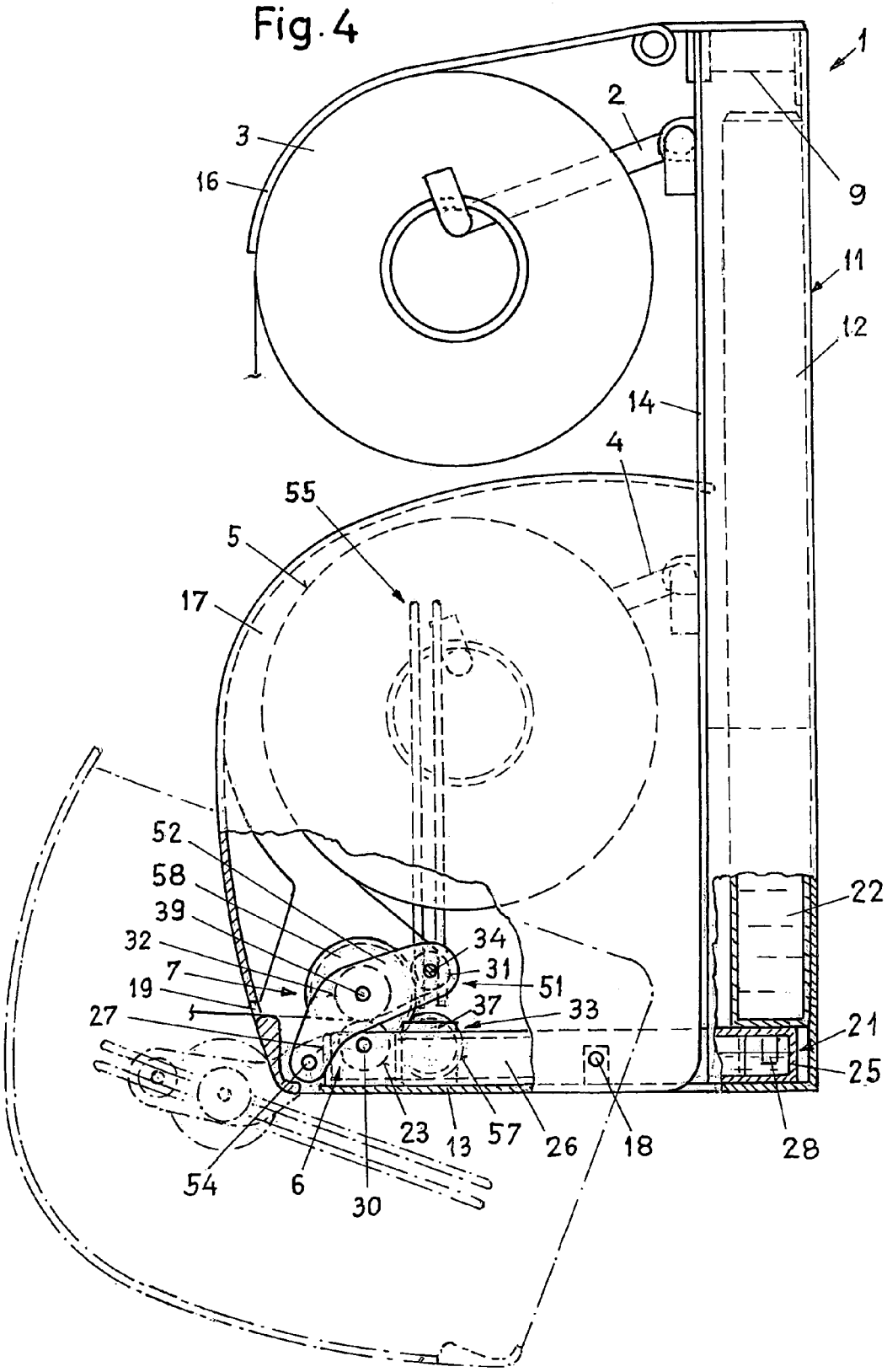
Figure 6:
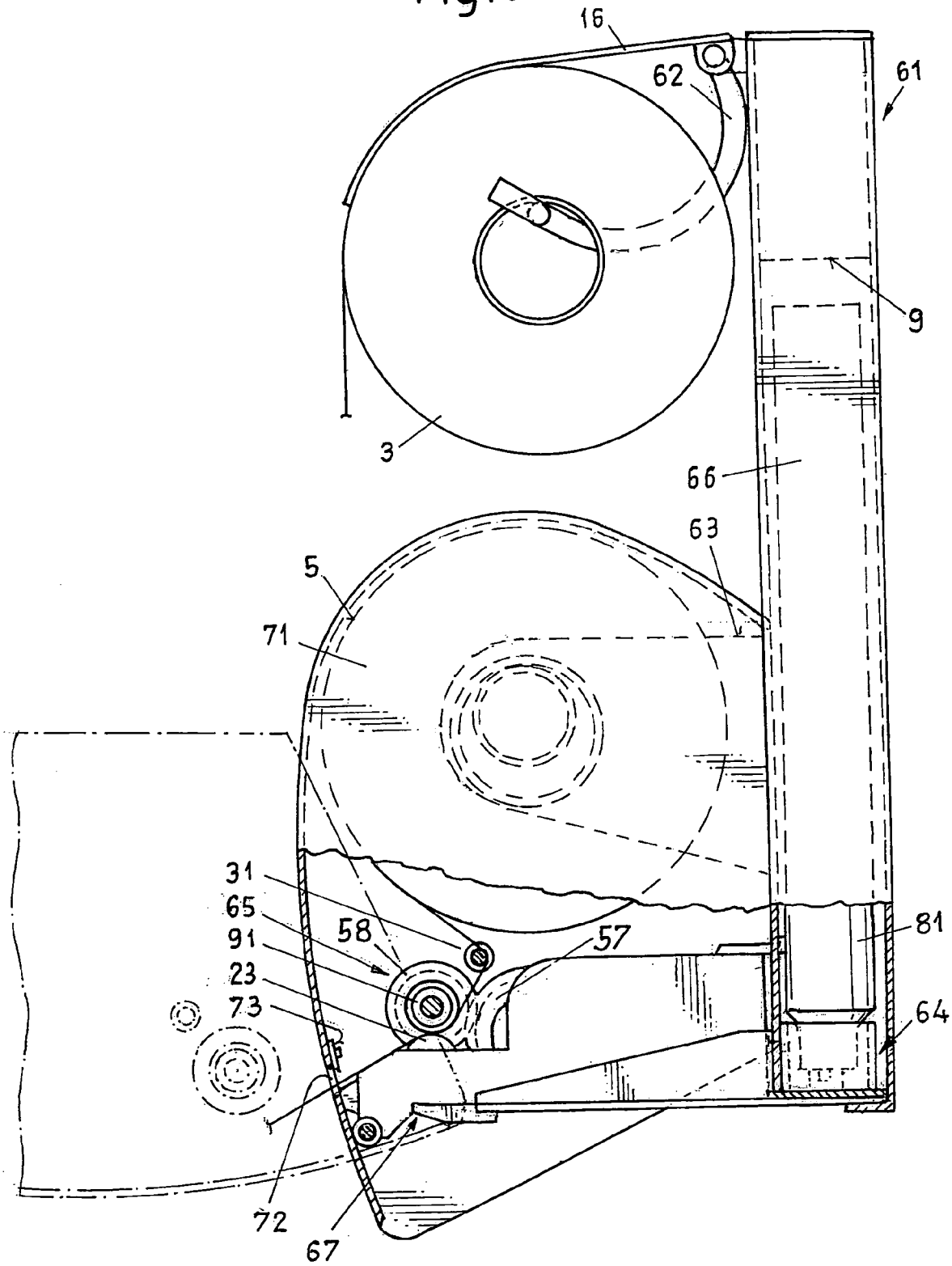
Figure 7:
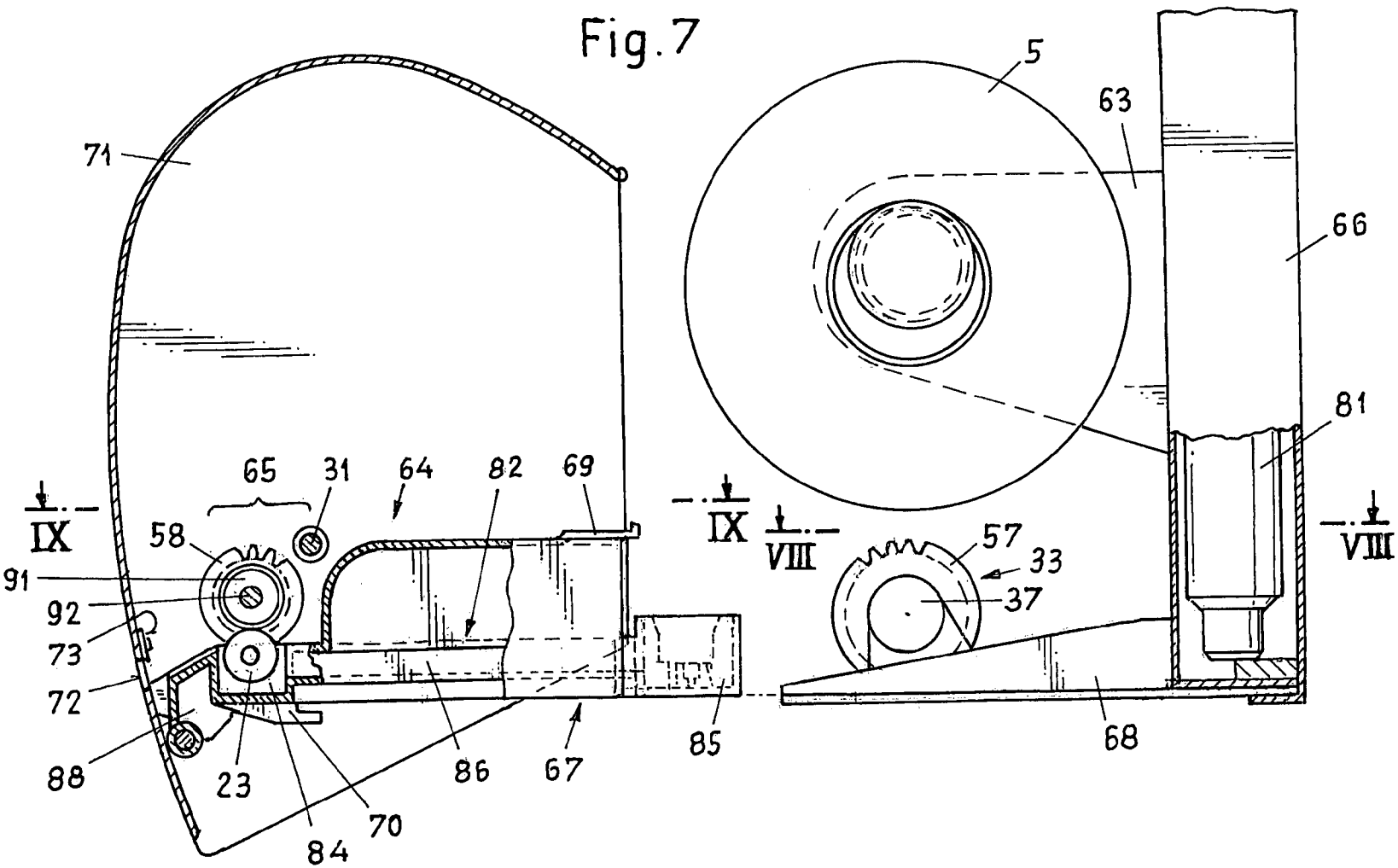
Figure 8:
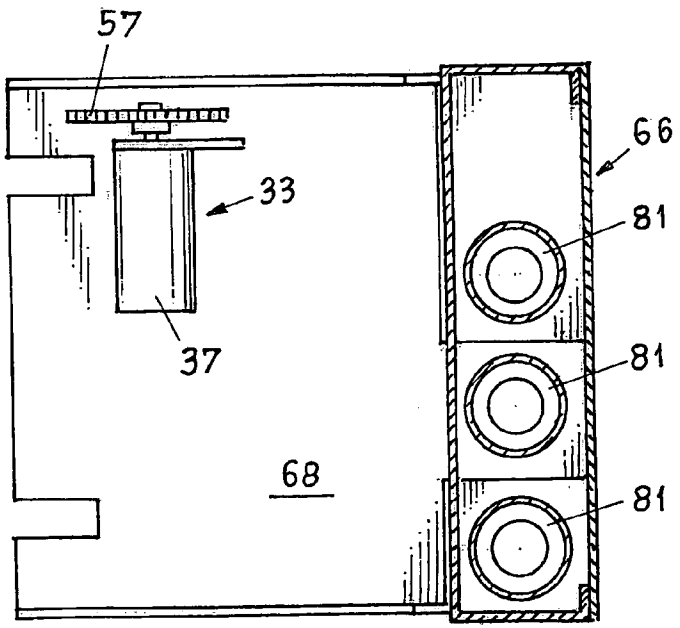
Figure 9:
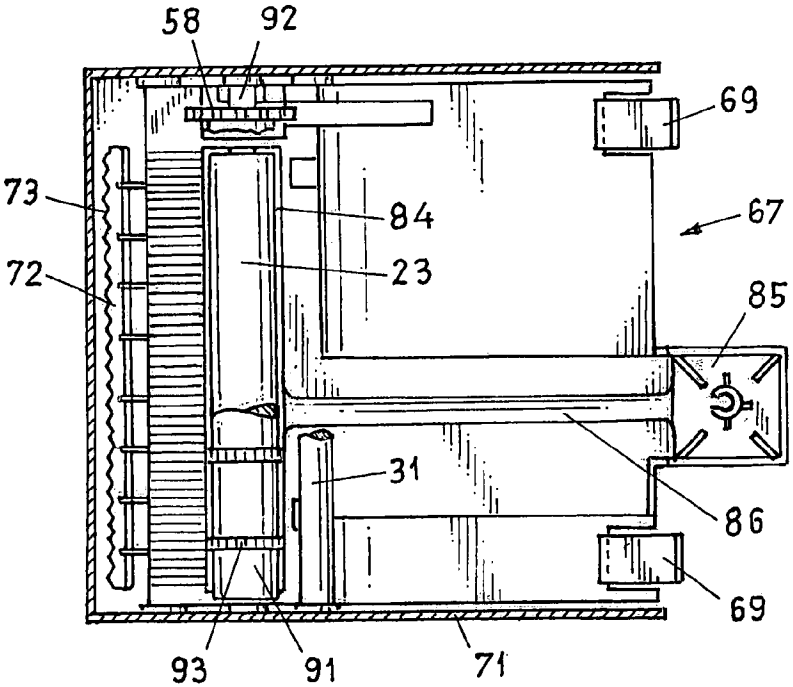

There are shown:

FIG. 1 a partly openly illustrated side view of a first embodiment of a dispenser in accordance with the invention;

FIG. 2 a section along the line II—II in FIG. 1;

FIG. 3 a section along the line III—III in FIG. 1;

FIG. 4 a partly openly illustrated side view of a second embodiment of a dispenser in accordance with the invention;

FIG. 5 a view of the transport unit in an unfolded position;

FIG. 6 a partly openly illustrated side view of a third embodiment of a dispenser in accordance with the invention;

FIG. 7 a side view of the dispenser in the separated state;

FIG. 8 a section along the line VIII—VIII in FIG. 7;

FIG. 9 a section along the line IX—IX in FIG. 7; and

Figure 10:
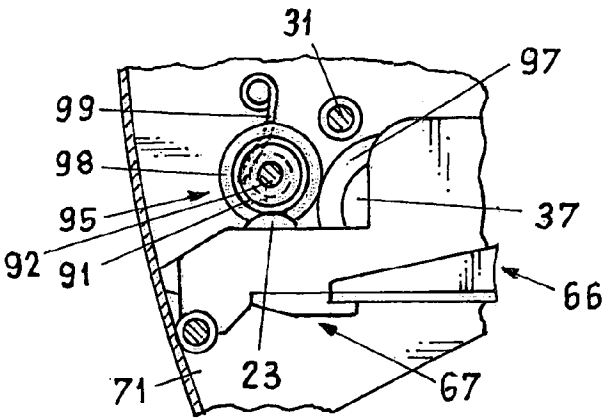

FIG. 10 a modification of the drive unit.

Reference is made to FIGS. 1 to 3. The dispenser contains a housing 1, a first roll holder 2 for the mounting of a dispensing roll 3 with toilet paper, a second roll holder 4 for the mounting of a dispensing roll 5 with paper to be moistened, a unit 6 for the moistening, a unit for the dispensing 7 of cleaning tissues and a control unit 9.

The housing 1 contains a U-shaped holder 11 consisting of a base section 12 for the fastening of the dispenser to a wall or the like and a wall section 13 projecting therefrom at right angles as well as a U-shaped support part 14 for the roll holders 2 and 4 which is arranged in the holder 11 and is releasably or fixedly connected thereto. The roll holders 2 and 4 are fastened to the base section of the support part 14. The housing 1 furthermore contains a pivotable flap 16, which is associated with the first roll holder 2, and a hood 17 to cover the wet part of the dispenser and is arranged pivotably about the axis 18. A slot 19 is provided in the hood 17 for the dispensing of the cleaning tissues.

The housing 1, the flap 16 and the hood 17 advantageously consist of plastic or of metal. Combinations of these materials can also be used.

The unit 6 for the moistening includes a liquid container 21, a liquid tank 22 and a moistening roll 23. The liquid container 21 is made in U shape such that the one limb 25 and the base section 26 are made as a tube and the other limb 27 is made as a trough. The liquid container 21 is arranged on the wall section 13 such that the one limb 23 lies beneath the liquid tank 22. The liquid tank 22 has a stub 28 which can be inserted into an aperture 29 provided in the limb 25 while simultaneously opening the liquid container. The moistening roll 23 is arranged in the limb 27 formed as a trough freely rotatably about the axis 30.

The unit 7 for the dispensing includes a guide roll 31, a transport roll 32 and a drive unit 33 for the transport roll 32. The guide roll 31 and the transport roll 32 are arranged in support members 35 rotatably about the axes 34 and 39, with the transport roll 32 lying on the moistening roll 23. A respective slot 36 is provided in the support members 35 for the insertion and raising of the transport roll 32. The drive unit 33 includes a stepping motor 37 having a belt pulley which is connected to the control unit 9, a belt pulley 38 fastened to the axle 39 of the transport roll 32 and a belt 40.

The control unit 9 is arranged in the housing 1 and includes a conventional electronic control which is charged by a battery and is activated by a switch.

Reference is made to the FIGS. 4 and 5. These Figures show a second embodiment of the dispenser and essentially differ from the first embodiment in the design of the unit for the dispensing. Only the differences are therefore described in the following description.

The unit 30 for the dispensing includes a guide roll 31, a transport roll 32 and a drive unit 33 for the transport roll 32. The guide roll 31 and the transport roll 32 are arranged on a holder 51. The holder 51 consists of two levers 52 and two axles 34 and 39 on which the guide roll 31 and the transport roll 32 are rotatably arranged, with the transport roll 32 lying on the moistening roll 23. The axles 32 and 39 are releasably mounted on the levers 52. It can be seen from FIG. 2 that the holder 51 is pivotably arranged about an axis 54 at the liquid container 21. Furthermore, a guide 55 is provided for the pivoting of the holder 51 on the hood 17 and is in active connection with the axle 34 of the guide roll 31.

The drive unit 33 includes a stepping motor 37 which is connected to the control unit 9, a first toothed wheel 57 which is fastened to the axle of the stepping motor 37 and a second toothed wheel 58 which is fastened to the axle 39 of the transport roll 32.

In a modified embodiment (not shown) of the previously described dispenser, the guide 55 is omitted such that the holder 51 can be manually adjusted when the hood 17 is open. Instead of the guide, a member is provided which holds the toothed wheels 57 and 58 in engagement when the hood 17 is closed.

Reference is made to the FIGS. 6 to 9. The dispenser contains a housing 61, a first roll holder 62 for the mounting of a dispensing roll 3 with toilet paper, a second roll holder 63 for the mounting of a dispensing roll 5 with hygiene paper to be moistened, a unit 64 for the moistening, a unit for the dispensing 65 and a control unit 9.

With respect to the embodiments described above, the housing 61 contains a base housing 66 for fastening to a wall or the like and an insertion part 67 which is releasably connected to the base housing 66. The base housing 66 consists of a rectangular box which is closed at the lower narrow side and is provided at the upper narrow side with closable apertures and of a support part 68 which projects at right angles and is fastened to the lower narrow side of the base housing 66. The roll holders 62, 63 are mounted to the base housing 66. The base housing 66 furthermore contains a pivotable flap 16. The insertion part 67 has latching jacks 69 which can be inserted into openings in the base housing 66 and support sections 70 into which the support part 68 can be inserted—the whole such that the insertion part 67 is removably arranged.

A hood 71 is pivotably arranged at a nose 88 which is formed at the insertion part 67. The hood 71 has an opening 72 for the dispensing of the moistened hygiene paper. A tear-off blade 73 is arranged in the region of the opening 72 at the hood wall or at the nose 88 of the insertion part 67 for the tearing off of moistened hygiene paper. A tear-off edge can be formed at the opening 72 instead of the tear-off blade.

With respect to the embodiments described above, the unit 64 for the moistening contains three liquid tanks 81, a liquid container 82 which is integrated into the insertion part 67 and a moistening roll 23. The liquid container 82 has a trough-shaped recess 84 for the mounting of the moistening roll 23, a connection section 85 for the connection of a liquid tank 81 and a channel-shaped recess 86 for the connection of the trough-shaped recess 84 to the connection section 86. The moistening roll 23 is arranged freely rotatably in the trough-shaped recess 84.

The unit 65 for the dispensing includes a guide roll 31, a transport roll 91 and a drive unit 33. With respect to the embodiments described above, the guide roll 31 and the transport roll 91 are arranged in the hood 71 and the drive unit 33 at the base housing 66 and also in the hood 71. The drive unit 33 includes a stepping motor 37 which is fastened to the support part 68 of the base housing 66, a first toothed wheel 57 which is fastened to the motor axle and a second toothed wheel 58 which is fastened to the axle 92 of the transport roll 91. The transport roll 91 has ring-shaped projections 93 at the periphery which are provided with ribbing to ensure the transport of the moistened hygiene paper.

The control unit 9 is arranged in the base housing 66 and contains an electronic circuit which is charged by a battery or from the mains network and is activated by a switch. The control unit 9 is advantageously designed such that, when the switch is actuated, a specific length of moistened hygiene paper is dispensed or, when the switch is actuated, any desired length of moistened hygiene paper is dispensed.

Reference is made to FIG. 10. Instead of the previously described embodiments, a modified drive unit can be provided which has a first friction wheel (97) connected to the stepping motor (37), a second friction wheel (98) connected to the transport roll (32; 91) and a spring element (99) to press the second friction wheel toward the first friction wheel. The transport roll is supported in an elongate hole for this purpose.

The invention claimed is:

1. A dispenser for hygiene paper, comprising a housing (1; 61); a roll holder (2; 62) for mounting a roll (3; 61) with a hygiene paper; a unit (6; 64) for moistening the hygiene paper and having a liquid container (21; 82), a moistening roll (23), and a liquid tank (22; 81) which communicates with the liquid container (21: 82); a guide roll (31) for the hygiene paper; a second roll holder (4; 63) for mounting a roll (5) with a second hygiene paper which is arranged beneath the first roll holder (2; 62); a dispensing unit (7; 65) with a transport roll (32; 91) for transporting the second hygiene paper, the transport roll being in contact with the moistening roll (23) through intermediary of a layer of the hygiene paper; a drive unit (33) for the transport roll (32; 91); and a control unit (9) for the drive unit (33), wherein the guide roll (31) and the transport roll (32) are freely rotatably supported on a holder (51), and the holder (51) is pivotably arranged at the housing (1).

2. A dispenser in accordance with claim 1, comprising a hood (17) for covering the roll (5) with the second hygiene paper, the guide roll (31), and the transport roll (32), wherein the hood (17) is pivotably supported at the housing (1) and has means (55) for pivoting both the hood and the holder (51) in a same direction.

3. Dispenser for hygiene paper or cleaning tissues, comprising a housing (1; 61); a roll holder (4; 63) for receiving a roll (5) with a hygiene paper; a unit (6; 64) for moistening the hygiene paper and having a liquid container (21: 82) with a moistening roll (23) and at least one liquid tank (22, 81) which communicates with the moistening roll (23); a unit (7; 65) for dispensing a moistened hygiene paper and having a transport roll (32; 91); and a drive unit (33) for the transport roll, wherein the roll holder (4; 63) and the liquid tank (22; 81) are arranged at the housing (1; 61); wherein the dispenser further comprises a hood (17) pivotally arranged on the housing for covering the roll with the hygiene paper; wherein a guide roll (31) for the hygiene paper is arranged between the moistening unit (64) and the roll (5) with the hygiene paper upstream of the transport roll (32; 91) and the moistening roll (23), and wherein the transport roll (32; 91) lies on the moistening roll (23) with the hygiene paper arranged therebetween; wherein the housing (61) comprises a base housing (66), an insert part (67), and means (69, 70), for releasably connecting the (22) base housing and the (23) insert part, and wherein the hood (71) covers the insert part (67) and is pivotally arranged on the insert part (67).

4. Dispenser in accordance with claim 3, wherein the moistening roll (23) is freely rotatably and removably arranged in the liquid container (21; 82).

5. Dispenser in accordance with claim 3, wherein the drive unit (33) contains a stepping motor which is secured to the base housing (66).

6. Dispenser in accordance with claim 5, wherein a belt drive is associated with the stepping motor (37) and is connected to the moistening roll (23).

7. Dispenser in accordance with claim 5, wherein a tooth drive is associated with the stepping motor (27) and is connected to the transport roll (91).

8. Dispenser in accordance with claim 3, wherein the moistening unit (6; 64) has three liquid tanks (81) arranged in the base housing (66), and the liquid container (82) is integrated into the insert part (67).

9. Dispenser in accordance with claim 3, wherein the liquid container (82) and the dispensing unit (65) for a moistened hygiene paper are provided at the insert part (67).

10. Dispenser for hygiene paper in accordance with claim 3, further comprising a further roll holder (2; 62) for receiving a further roll (3; 61) with a further hygiene paper, wherein a flap (16) is pivotally arranged at the housing (1) to hold back the further hygiene paper kept available for manual draw-off.

11. Dispenser in accordance with claim 10, wherein the roll holder (4; 63) for receiving the hygiene paper to be moistened is disposed beneath the further roll holder (2; 62).

12. Dispenser in accordance with claim 3, wherein the housing (1) is formed of at least one of plastics and metal.

13. Dispenser in accordance with claim 3, wherein the guide roll (31) and the transport roll (32) are freely rotatably arranged on a holder (51), and the holder (51) is pivotally arranged at the housing (1).

14. Dispenser in accordance with claim 3, wherein the hood (17) has means (55) for pivoting the hood (17) and the holder (51) in a same direction.

15. Dispenser in accordance with claim 3, wherein the transport roll (91) is provided, at a periphery thereof with ring-shaped projections (93) which are provided with a corrugation.

16. Dispenser for hygiene paper or cleaning tissues, comprising a housing (1; 61); a roll holder (4; 63) for receiving a roll (5) with a hygiene paper; a unit (6; 64) for moistening the hygiene paper and having a liquid container (21: 82) with a moistening roll (23) and at least one liquid tank (22, 81) which communicates with the moistening roll (23); a unit (7; 65) for dispensing a moistened hygiene paper and having a transport roll (32; 91); and a drive unit (33) for the transport roll, wherein the roll holder (4; 63) and the liquid tank (22; 81) are arranged at the housing (1; 61); wherein the dispenser further comprises a hood (17) pivotally arranged on the housing for covering of the roll with the hygiene paper; wherein a guide roll (31) is arranged between the moistening unit (64) and the roll (5) with the hygiene paper, and wherein the transport roll (32; 91) lies on the moistening roll (23) with the hygiene paper arranged therebetween, wherein the guide roll (31) and the transport roll (32; 91) are rotatably arranged in the hood (17).

* * * * *